US009466256B2

(12) United States Patent
Wang et al.

(10) Patent No.: US 9,466,256 B2
(45) Date of Patent: Oct. 11, 2016

(54) GAMMA VOLTAGE GENERATING CIRCUIT, CONTROLLING METHOD THEREOF, AND LIQUID CRYSTAL DISPLAY

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Qian Wang, Beijing (CN); Hyungkyu Kim, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 68 days.

(21) Appl. No.: 14/361,994

(22) PCT Filed: Oct. 10, 2013

(86) PCT No.: PCT/CN2013/084999

§ 371 (c)(1),
(2) Date: May 30, 2014

(87) PCT Pub. No.: WO2015/000239

PCT Pub. Date: Jan. 8, 2015

(65) Prior Publication Data

US 2015/0130852 A1 May 14, 2015

(30) Foreign Application Priority Data

Jul. 1, 2013 (CN) ..... 2013 1 0272216

(51) Int. Cl.
*G09G 3/36* (2006.01)
*G09G 3/20* (2006.01)

(52) U.S. Cl.
CPC ..... *G09G 3/3696* (2013.01); *G09G 3/20* (2013.01); *G09G 3/36* (2013.01); *G09G 3/3685* (2013.01); *G09G 2320/0276* (2013.01); *G09G 2320/0673* (2013.01)

(58) Field of Classification Search
None
See application file for complete search history.

(56) References Cited

U.S. PATENT DOCUMENTS 7,027,017 B2 4/2006 Yer
2002/0186230 A1* 12/2002 Kudo ..... G09G 3/3607 345/690

(Continued)

FOREIGN PATENT DOCUMENTS

CN 1453758 A 11/2003
CN 1658275 A 8/2005

(Continued)

OTHER PUBLICATIONS

International Search Report and Written Opinion mailed Apr. 3, 2014 regarding PCT/CN2013/084999. Translation provided by Dragon Intellectual Property Law Firm.

(Continued)

*Primary Examiner* — Tony N Ngo
(74) *Attorney, Agent, or Firm* — Harness, Dickey & Pierce, P.L.C.

(57) ABSTRACT

The present disclosure relates to a gamma voltage generating circuit, a controlling method thereof and a liquid crystal display. The gamma voltage generating circuit comprises an output end, a first reference voltage input end, a second reference voltage input end, a pre-stage voltage-dividing circuit, and a post-stage voltage-dividing circuit. A first pre-stage output end of the pre-stage voltage-dividing circuit is coupled to a first post-stage input end, and a second pre-stage output end is coupled to a second post-stage input end, so as to divide reference voltages input from the first and second reference voltage input ends, thereby to generate a primary gamma voltage. A post-stage output end of the post-stage voltage-dividing circuit is coupled to the output end of the gamma voltage generating circuit, so as to divide the primary gamma voltage, thereby to generate a secondary gamma voltage.

13 Claims, 5 Drawing Sheets

(56) References Cited

U.S. PATENT DOCUMENTS

| | | | | |
|---|---|---|---|---|
| 2003/0122814 | A1 | 7/2003 | Yer | |
| 2005/0007393 | A1* | 1/2005 | Akai | G09G 3/3233 345/690 |
| 2006/0087483 | A1* | 4/2006 | Takada | G09G 3/3688 345/89 |
| 2009/0051575 | A1* | 2/2009 | Lee | G09G 3/20 341/136 |

FOREIGN PATENT DOCUMENTS

| | | | | |
|---|---|---|---|---|
| CN | 1917004 | A | 2/2007 | |
| CN | 1917004 | A * | 2/2007 | G09G 3/20 |
| CN | 101063754 | A | 10/2007 | |
| CN | 101388670 | A | 3/2009 | |
| CN | 101393730 | A | 3/2009 | |
| CN | 101414452 | A | 4/2009 | |
| JP | 2006276114 | A | 10/2006 | |

OTHER PUBLICATIONS

Chinese Office Action mailed May 4, 2015 regarding Chinese Application No. 201310272216.9. Translation provided by Dragon Intellectual Property Law Firm.

* cited by examiner

GAMMA VOLTAGE GENERATING CIRCUIT, CONTROLLING METHOD THEREOF, AND LIQUID CRYSTAL DISPLAY

CROSS-REFERENCE TO RELATED APPLICATIONS

This application is the U.S. national phase of PCT Application No. PCT/CN2013/084999 filed on Oct. 10, 2013, which claims priority to Chinese patent application No. 201310272216.9 filed on Jul. 1, 2013, the disclosures of which are incorporated herein by reference in their entirety.

TECHNICAL FIELD

The present invention relates to the field of display technology, in particular to a gamma voltage generating circuit, controlling method thereof, and a liquid crystal display.

BACKGROUND

Gamma voltage generating circuit functions as to, in accordance with a gamma curve required by a thin film transistor liquid crystal display (TFT-LCD), set gamma voltages as voltages for gray scale display of the TFT-LCD. Each gamma voltage generates all the gray scale voltages under the effect of a digital-to-analog converter of a source driver.

Currently, for the LCD, the gamma voltage generating circuit is usually provided in a source driver IC, and generates the desired respective gamma voltage by adopting voltage dividing resistors. Eight (V1, V2, . . . , V7, V8) or fourteen (V1, V2, . . . , V13, V14) voltage nodes are extracted and those voltages are applied to an external output as shown in FIGS. 1 and 2. FIG. 1 shows the main structure of the source driver IC, which includes the gamma voltage generating circuit, a gamma lookup table, and the source driver.

A relatively large amount of resistors are required to achieve such a gamma voltage generating circuit. For instance, a 6-bit source driver IC needs 129 resistors, and an 8-bit source driver IC needs 257 resistors. These resistors will occupy large space of the source driver IC. In addition, the number of the gamma voltages needs to be increases so as to improve the gray scale display properties of the LCD. Correspondingly, it needs more resistors to constitute the existing gamma voltage generating circuit so as to generate the desired number of gamma voltages. As a result, it is adverse to the integration of the source driver IC, as well as the reduction of the process complexity and the cost.

SUMMARY

An object of the present invention is to provide a gamma voltage generating circuit, its controlling method, and a liquid crystal display, so as to reduce the number of resistors in the gamma voltage generating circuit in the prior art, thereby to facilitate the integration of a source driver IC and reduce the process complexity of the source driver IC.

In one aspect, an embodiment of the present invention provides a gamma voltage generating circuit, comprising: an output end, a first reference voltage input end, a second reference voltage input end, a pre-stage voltage-dividing circuit having a first pre-stage output end and a second pre-stage output end, and a post-stage voltage-dividing circuit having a first post-stage input end, a second post-stage input end and a post-stage output end.

The first reference voltage input end and the second reference voltage input end are coupled to the pre-stage voltage-dividing circuit respectively, the pre-stage voltage-dividing circuit is coupled to the post-stage voltage-dividing circuit, and the post-stage voltage-dividing circuit is coupled to the output end of the gamma voltage generating circuit.

The first pre-stage output end of the pre-stage voltage-dividing circuit is coupled to the first post-stage input end, and the second pre-stage output end of the pre-stage voltage-dividing circuit is coupled to the second post-stage input end, so as to divide reference voltages input from the first reference voltage input end and the second reference voltage input end, respectively, thereby to generate a primary gamma voltage.

The post-stage output end of the post-stage voltage-dividing circuit is coupled to the output end of the gamma voltage generating circuit, so as to divide the primary gamma voltage, thereby to generate a secondary gamma voltage.

In another aspect, an embodiment of the present invention provides a method for controlling the above-mentioned gamma voltage generating circuit, comprising: determining a desired gamma voltage by a source driver; dividing reference voltages input from a first reference voltage input end and a second reference voltage input end, respectively, so as to generate a primary gamma voltage by a pre-stage voltage-dividing circuit; dividing the primary gamma voltage by a post-stage voltage-dividing circuit, so as to generate a secondary gamma voltage; and outputting the desired gamma voltage through an output end of the gamma voltage generating circuit.

In yet another aspect, an embodiment of the present invention provides a liquid crystal display comprising the above-mentioned gamma voltage generating circuit.

According to embodiments of the present invention, the pre-stage voltage-dividing circuit is multiplexed by the post-stage voltage-dividing circuit, so it is able to generate more gamma voltages using less elements, thereby to facilitate the integration of the source driver IC and reduce the process complexity of the source driver IC.

DETAILED DESCRIPTION

The present invention will be described hereinafter in conjunction with the drawings. It should be appreciated that, the following embodiments are merely used to illustrate and explain the present invention, but shall not be used to limit the present invention.

The technical solutions provided by embodiments of the present invention are described in detail as follows.

First Embodiments

Figure 3:
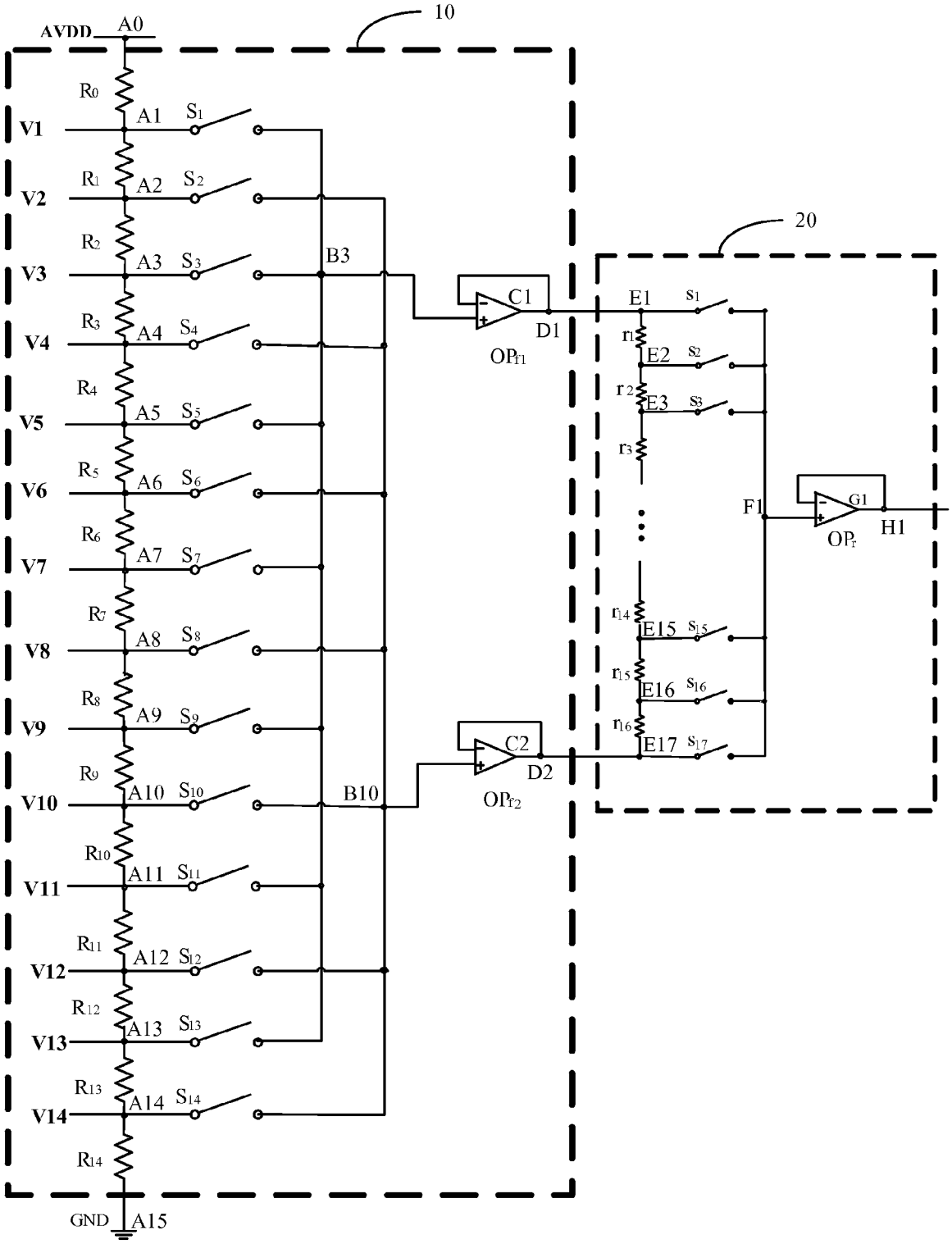
FIG. 3 is a circuit diagram of a gamma voltage generating circuit according to the first embodiment of the present invention.

FIG. 3 is a circuit diagram of a gamma voltage generating circuit according to the first embodiment of the present invention. It is to be noted that, in FIG. 3, A1, A2, . . . , A14 represent connection points between resistors $R_0$, $R_1$, $R_2$, $R_3$, . . . , $R_{14}$ and switches $S_1$, $S_2$, $S_3$, . . . , $S_{14}$, respectively, B3 and B10 represent cross-connection points in a pre-stage voltage dividing circuit 10, and E1, E2, . . . , E17 represent connection points between resistors $r_1$, $r_2$, . . . , $r_{17}$ and switches $s_1$, $s_2$, . . . , $s_{17}$, respectively.

As shown in FIG. 3 where the number (N) of pre-stage resistors included in the pre-stage voltage-dividing circuit 10 is 15 (i.e., $R_0$, $R_1$, $R_2$, $R_3$, . . . , $R_{14}$) and the number (M) of post-stage resistors included in a post-stage voltage-dividing circuit 20 is 16 (i.e., $r_1$, $r_2$, $r_3$, . . . , $r_{16}$), the gamma voltage generating circuit comprises an output end H1, a first reference voltage input end A0, a second reference voltage input end A15, the pre-stage voltage-dividing circuit 10 and the post-stage voltage-dividing circuit 20.

The first reference voltage input end A0 and the second reference voltage input end A15 are coupled to the pre-stage voltage-dividing circuit 10, respectively, the pre-stage voltage-dividing circuit 10 is coupled to the post-stage voltage-dividing circuit 20, and the post-stage voltage-dividing circuit 20 is coupled to the output end H1 of the gamma voltage generating circuit.

The pre-stage voltage-dividing circuit 10 has a first pre-stage output end D1 and a second pre-stage output end D2.

The post-stage voltage-dividing circuit 20 has a first post-stage input end E1, a second post-stage input end E17 and a post-stage output end G1.

The first pre-stage output end D1 of the pre-stage voltage-dividing circuit 10 is coupled to the first post-stage input end E1, and the second pre-stage output end D2 of the pre-stage voltage-dividing circuit 10 is coupled to the second post-stage input end E17, so as to divide reference voltages from the first reference voltage input end A0 and the second reference voltage input end A15, thereby to generate a primary gamma voltage.

The primary gamma voltage is generated by the pre-stage voltage-dividing circuit 10. As a first step of generating the gamma voltage, the pre-stage voltage-dividing circuit 10 divides a first reference voltage and a second reference voltage into a predetermined number of primary voltages.

The voltage from the first reference voltage input end A0 may be a positive supply voltage AVDD, and the voltage from the second reference voltage input end A15 may be 0, i.e., the second reference voltage input end A15 is grounded. As shown in FIG. 3, the voltage from the second reference voltage input end A15 may also be a supply voltge AVDD with a phase opposite to, and an amplitude identical to, that of the voltage from the first reference voltage input end A0.

The post-stage output end G1 of the post-stage voltage-dividing circuit 20 is coupled to the output end H1 of the gamma voltage generating circuit, so as to divide the primary gamma voltage, thereby to generate a secondary gamma voltage.

The secondary gamma voltage is a final gamma voltage obtained by performing the second voltage dividing, through the post-stage voltage-dividing circuit 20, on each of the predetermined number of the primary voltages.

The pre-stage voltage-dividing circuit 10 comprises N+1 pre-stage resistors (i.e., the $0^{th}$ pre-stage resistor $R_0$ to the $N^{th}$ pre-stage resistor $R_N$), a first switch group (i.e., N pre-stage switches including the $1^{st}$ pre-stage switch $S_1$ to the $N^{th}$ switch $S_N$), and 2 pre-stage operational amplifiers (i.e., the $1^{st}$ pre-stage operational amplifier $OP_{f1}$ and the $2^{nd}$ pre-stage operational amplifier $OP_{f2}$).

The N+1 pre-stage resistors are sequentially coupled in series (e.g., the pre-stage resistors $R_0$, $R_1$, $R_2$, $R_3$, . . . , $R_{14}$ are sequentially coupled in series as shown in FIG. 3). One end of the $0^{th}$ pre-stage resistor $R_0$, which is not coupled to the $1^{st}$ pre-stage resistor $R_1$ (e.g., an end A0 as shown in FIG. 3) is coupled to the first reference voltage input end A0, and one end of the $N^{th}$ resistor $R_N$, which is not coupled to the $(N-1)^{th}$ resistor $R_{N-1}$, is coupled to the second reference voltage input end A15.

One end of the $n^{th}$ pre-stag switch $S_n$ is coupled to a common node between the $(n-1)^{th}$ pre-stage resistor and the $n^{th}$ pre-stage resistor $R_{n-1}$ (e.g., as shown in FIG. 3, one end of the switch $S_3$ is coupled to the common node A3 between the pre-stage resistor $R_2$ and the pre-stage resistor $R_3$, or to the common node A10 between the pre-stage resistor $R_9$ and the pre-stage resistor $R_{10}$), and the other end of the $n^{th}$ pre-stag switch $S_n$ is coupled to an in-phase input end of the $1^{st}$ pre-stage operational amplifier $OP_{f1}$ or the $2^{nd}$ pre-stage operational amplifier $OP_{f2}$, wherein n is a positive integer not less than 1 and not greater than (N+1), and N is a positive integer greater than 1.

In order to select the desired gamma voltage using the switch-on and switch-off states of the pre-stage switches, when n is an odd number, the other end of the $n^{th}$ pre-stage switch Sn is coupled to an in-phase input end of the $1^{st}$ pre-stage operational amplifier $OP_{f1}$ (e.g., when n=3, the other end of the switch $S_3$ is coupled to the in-phase input end of the $1^{st}$ pre-stage operational amplifier $OP_{f1}$), and when n is an even number, the other end of the $n^{th}$ pre-stage switch $S_n$ is coupled to an in-phase input end of the $2^{nd}$ pre-stage operational amplifier $OP_{f2}$ (e.g., when n=10, the other end of the switch $S_{10}$ is coupled to the in-phase input end of the $2^{nd}$ pre-stage operational amplifier $OP_{f2}$).

An reverse-phase input end and an output end (i.e., an output end C1) of the $1^{st}$ pre-stage operational amplifier $OP_{f1}$ are both coupled to the first pre-stage output end (e.g., a first pre-stage output end D1 in FIG. 3), and an reverse-phase inpute end and an output end of the $2^{nd}$ pre-stage operational amplifier $OP_{f2}$ are both coupled to the second pres-stage output end (e.g., a second pre-stage output end D2 in FIG. 3).

The post-stage voltage-dividing circuit 20 comprises M post-stage resistors (i.e., the $1^{st}$ post-stage resistor $r_1$ to the $M^{th}$ post-stage resistor $r_M$), a second switch group (i.e., M+1 post-stage switches including the $1^{st}$ post-stage switch $s_1$ to the $(M+1)^{th}$ post-stage switch $S_{M+1}$), and R post-stage operational amplifiers (i.e., the $1^{st}$ post-stage operational amplifier to the $R^{th}$ post-stage operational amplifier), wherein R is a positive integer not less than 1. In the circuit as shown in FIG. 3, there is only one post-stage operational amplifier $OP_r$.

The M post-stage resistors are sequentially coupled in series (e.g., the post-stage resistors $r_1$, $r_2$, $r_3$, . . . , $r_{16}$ are sequentially coupled in series as shown in FIG. 3). One end of the $1^{st}$ post-stage resistor $r_1$, which is not coupled to the $2^{nd}$ post-stage resistor $r_2$, is coupled to the first post-stage input end (e.g., E1 in FIG. 3), and one end of the $M^{th}$ post-stage resistor $r_M$, which is not coupled to the $(M-1)^{th}$ post-stage resistor $r_{M-1}$, is coupled to the second post-stage input end (e.g., E17 in FIG. 3).

One end of the $1^{st}$ post-stage switch $S_1$ is coupled to the first post-stage input end (e.g., E1 in FIG. 3), and the other end of the $1^{st}$ post-stage switch $S_1$ is coupled to an in-phase input end of any one of the R post-stage operational amplifies (e.g., an in-phase input end F1 of the post-stage operational amplifier $OP_r$). One end of the $(M+1)^{th}$ post-stage switch $S_{M+1}$ is coupled to the second post-stage input end (e.g., E17 in FIG. 3), and the other end of the $(M+1)^{th}$ post-stage switch $S_{M+1}$ is coupled to an in-phase input end of any one of the R post-stage operational amplifiers (e.g., the in-phase input end F1 of the post-stage operational amplifier $OP_r$).

One end of the $m^{th}$ post-stage switch $s_m$ is coupled to a common node between the $(m-1)^{th}$ post-stage resistor $r_{m-1}$ and the $m^{th}$ post-stage resistor $r_m$ (e.g., one end of the switch $S_3$ is coupled to a common node E3 between the post-stage resistor $r_2$ and the post-stage resistor $r_3$), and the other end of the $m^{th}$ post-stage switch $s_m$ is coupled to an in-phase input end of any one of the R post-stage operational amplifiers (e.g., the other end of the switch $S_3$ is coupled to the in-phase input end F1 of the post-stage operational amplifier $OP_r$). m is a positive integer not less than 1 and not greater than M+1, and M is a positive integer greater than 1.

In order to reduce the number of the post-stage operational amplifiers and facilitate the integration of the source driver, the number (R) of the post-stage operational amplifiers in the post-stage voltage-dividing circuit is 1. At this time, the other ends of all the post-stage switches in the post-stage voltage dividing circuit are coupled to the in-phase input end of the post-stage operational amplifier $OP_r$, as shown in FIG. 3.

Among the R post-stage operational amplifiers, the reverse-phase input end and the output end of each post-stage operational amplifier (e.g., the output end G1 of the post-stage operational amplifier $OP_r$) are both coupled to the post-stage output end (e.g., the post-stage output end H1 in FIG. 3), and the post-stage output end is coupled to the output end of the gamma voltage generating circuit.

In the gamma voltage generating circuit (which has the circuit diagram as shown in FIG. 3) of the first embodiment, the pre-stage voltage-dividing circuit 10 is multiplexed by the post-stage voltage-dividing circuit 20. Under the function of the pre-stage voltage-dividing circuit 10 and the post-stage voltage-dividing circuit 20 (more specifically the first switch group of the pre-stage voltage-dividing circuit 10 and the second switch group of the post-stage voltage-dividing circuit 20), more gamma voltages may be generated using less resistors. As a result, it is able to reduce the number of the gamma resistors, thereby to facilitate the integration of the high-bit source driver IC and reduce the process complexity of the source driver IC.

It is to be noted that, in FIG. 3, the voltage from the first reference voltage input end A0 is a positive supply voltage AVDD and the second reference voltage input end A15 is grounded (GND). It should be appreciated that, the supply voltage from the second reference voltage input end A15 may be −AVDD. At this time, one end of the $(N/2)^{th}$ pre-stage switch $S_{N/2}$, which is not coupled to the $1^{st}$ or $2^{nd}$ pre-stage operational amplifier, is grounded, one end of the $(N/2+1)^{th}$ pre-stage switch $S_{N/2+1}$, which is not coupled to the $1^{st}$ or $2^{nd}$ pre-stage operational amplifier, is grounded too, and the connection relationship of the other elements remains unchanged.

Figure 4:
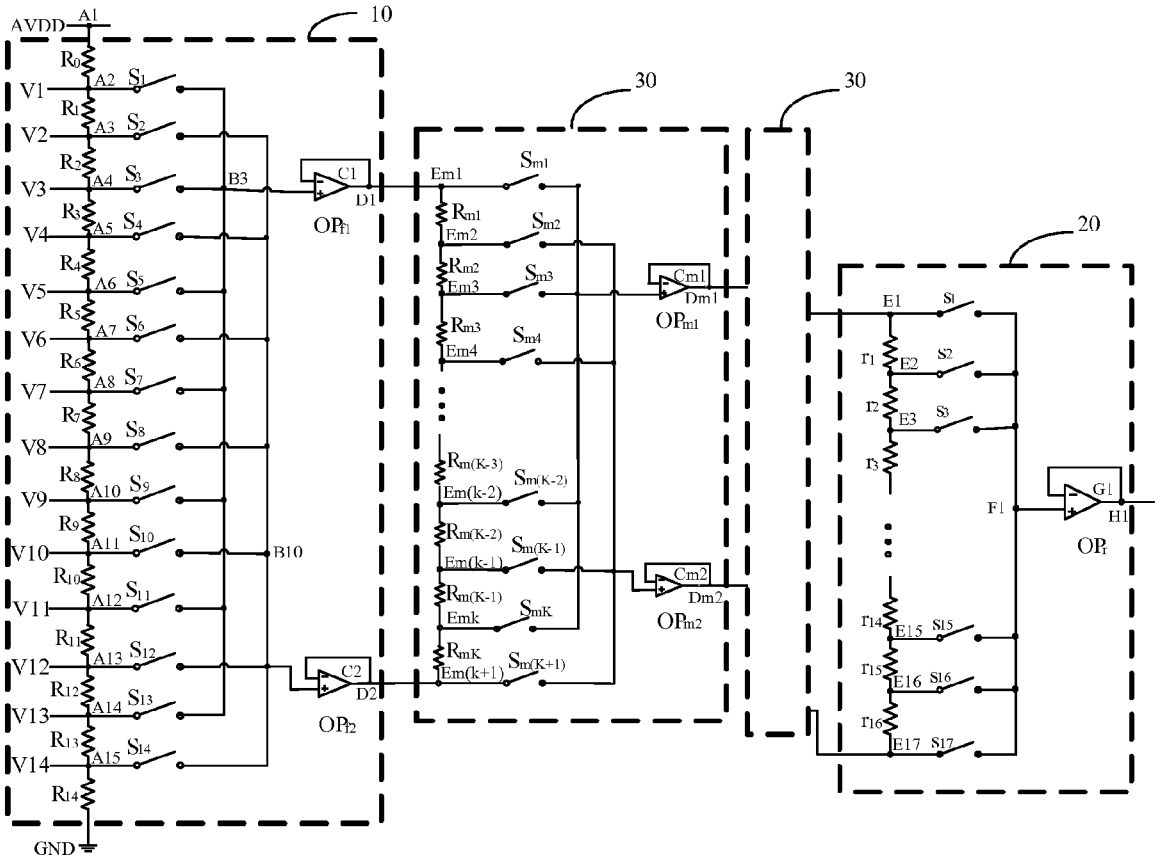
FIG. 4 is another circuit diagram of the gamma voltage generating circuit according to the first embodiment of the present invention.

The gamma voltage generating circuit in FIG. 3 may be called as a two-stage multiplex circuit. In order to generate more gamma voltages, a three-stage, or more, multiplex circuit may also be used. At this time, on the basis of the circuit as shown in FIG. 3, at least one intermediate-stage voltage-dividing circuit 30 having first intermediate-stage input/output ends and second intermediate-stage input/output ends may be added, and its structure is shown in FIG. 4. In FIG. 4, two intermediate-stage voltage-dividing circuits are added. The circuit diagram of the second intermediate-stage voltage-dividing circuit is similar to that of the first intermediate-stage voltage-dividing circuit. FIG. 4 merely shows the connection between the second intermediate-stage voltage-dividing circuit and the first intermediate-stage voltage-dividing circuit as well as the post-stage voltage-dividing circuit, without showing the specific structure of the second intermediate-stage voltage-dividing circuit.

A first intermediate-stage input end of the intermediate-stage voltage-dividing circuit 30 (e.g., Em1) is coupled to a first output end of an previous-stage voltage-dividing circuit (e.g., D1), a second intermediate-stage input end (e.g., Em(k+1)) is coupled to a second output end of the previous-stage voltage-dividing circuit (e.g., D2), a first intermediate-stage output end (e.g., Dm1 as shown in FIG. 4) is coupled to a first input end of a next-stage voltage-dividing circuit, and a second intermediate-stage output end (e.g., Dm2 in FIG. 4) is coupled to a second output end of the next-stage voltage-dividing circuit, so as to divide the voltage output from the previous-stage voltage-dividing circuit.

The post-stage voltage-dividing circuit 20 is specifically used to divide the voltage from the previous-stage voltage-dividing circuit, thereby to generate the secondary gamma voltage.

The previous-stage voltage-dividing circuit and the next-stage voltage-dividing circuit will be described hereinafter.

On the basis of the circuit as shown in FIG. 3, when the intermediate-stage voltage-dividing circuit 30 having the first intermediate-stage input/output ends and the second intermediate-stage input/output ends is added, the previous-stage voltage-dividing circuit is just the pre-stage voltage-dividing circuit, the first output end of the previous-stage voltage-dividing circuit is just the first pre-stage output end and the second output end of the previous-stage voltage-dividing circuit is just the second pre-stage output end, while the next-stage voltage-dividing circuit is just the post-stage voltage-dividing circuit, the first input end of the next-stage voltage-dividing circuit is just the first post-stage input end and the second input end the next-stage voltage-dividing circuit is just the second post-stage input end.

On the basis of the circuit as shown in FIG. 3, when two intermediate-stage voltage-dividing circuits (i.e., the first intermediate-stage voltage-dividing circuit and the second intermediate-stage voltage-dividing circuit) having the first intermediate-stage input/output ends and the second intermediate-stage input/output ends are added and the intermediate-stage voltage-dividing circuit is the first intermediate-stage voltage-dividing circuit, as shown in FIG. 4, the previous-stage voltage-dividing circuit is just the pre-stage voltage-dividing circuit, the first output end of the previous-stage voltage-dividing circuit is just the first pre-stage output end and the second output end of the previous-stage voltage-dividing circuit is just the second pre-stage output end. While the next-stage voltage-dividing circuit is just second intermediate-stage voltage-dividing circuit, the first input end of the next-stage voltage-dividing circuit is the first intermediate-stage input end of the second intermediate-stage voltage-dividing circuit, the second input end of the next-stage voltage-dividing circuit is the second intermediate-stage input end of the second intermediate-stage voltage-dividing circuit. While intermediate-stage voltage-dividing circuit is the second intermediate-stage voltage-dividing circuit, the previous-stage voltage-dividing circuit is just the first intermediate-stage voltage-dividing circuit, the first output end of the previous-stage voltage-dividing circuit is just the first intermediate-stage output end of the first intermediate-stage voltage-dividing circuit and the second output end of the previous-stage voltage-dividing circuit is just the second intermediate-stage output end of the first intermediate-stage voltage-dividing circuit, while the next-stage voltage-dividing circuit is just the post-stage voltage-dividing circuit, the first input end of the next-stage voltage-dividing circuit is just the first post-stage input end and the second input end of the next-stage voltage-dividing circuit is just the second post-stage input end. When three or more intermediate-stage voltage-dividing circuits are added, the case is similar to adding two intermediate-stage voltage-dividing circuits, and it will not be repeated herein.

When merely one intermediate-stage voltage-dividing circuit 30 is included, its first intermediate-stage input end is coupled to the first pre-stage output end, its second intermediate-stage input end is coupled to the second pre-stage output end, its first intermediate-stage output end is coupled to the first post-stage input end, and its second intermediate-stage output end is coupled to the second post-stage input end.

As shown in FIG. 4, the intermediate-stage voltage-dividing circuit 30 comprises K intermediate-stage resistors (i.e., the $1^{st}$ intermediate-stage resistor $R_{m1}$ to the $K^{th}$ intermediate-stage resistor $R_{mK}$), a first intermediate switch group (i.e., K+1 intermediate-stage switches including the $1^{st}$ intermediate-stage switch $S_{m1}$ to the $(K+1)^{th}$ intermediate-stage switch $S_{m(K+1)}$), and 2 intermediate-stage operational amplifiers (i.e., the $1^{st}$ intermediate-stage operational amplifier $OP_{m1}$ and the $2^{nd}$ intermediate-stage operational amplifier $OP_{m2}$).

The K intermediate-stage resistors are sequentially coupled in series. One end of the $1^{st}$ intermediate-stage resistor $R_{m1}$, which is not coupled to the $2^{nd}$ intermediate-stage resistor $R_{m2}$, is coupled to the first intermediate-stage input end, and one end of the $K^{th}$ intermediate-stage resistor $R_{mK}$, which is not coupled to the $(K-1)^{th}$ intermediate-stage resistor $R_{m(K-1)}$, is coupled to the second intermediate-stage input end.

One end of the $1^{st}$ intermediate-stage switch is coupled to the first intermediate-stage input end, and the other end of the $1^{st}$ intermediate-stage switch is coupled to an in-phase input of the $1^{st}$ or $2^{nd}$ intermediate-stage operational amplifier. One end of the $(K+1)^{th}$ intermediate-stage switch is coupled to the second intermediate-stage input end, and the other end of the $(K+1)^{th}$ intermediate-stage switch is coupled to an in-phase input end of the $1^{st}$ or $2^{nd}$ intermediate-stage operational amplifier. One end of the $k^{th}$ intermediate-stage switch is coupled to a common node between the $(k-1)^{th}$ intermediate-stage resistor and the $k^{th}$ intermediate-stage resistor, and the other end of the $k^{th}$ intermediate-stage switch is coupled to an in-phase input end of the $1^{st}$ or $2^{nd}$ intermediate-stage operational amplifier. k is a positive integer greater than 1 and not greater than K+1, and K is a positive integer greater than 1.

A reverse-phase input end and an output end of the $1^{st}$ intermediate-stage operational amplifier $OP_{m1}$ are both coupled to the first intermediate-stage output end, and a reverse-phase input end and an output end of the $2^{nd}$ intermediate-stage operational amplifier $OP_{m2}$ are both coupled to the second intermediate-stage output end.

In order to select the desired gamma voltage using the switch-on and switch-off state of the pre-stage switch, one end of the $1^{st}$ intermediate-stage switch $S_{m1}$ is coupled to the first intermediate-stage input end, and the other end thereof is coupled to an in-phase input end of the $1^{st}$ intermediate-stage operational amplifier $OP_{m1}$. One end of the $(K+1)^{th}$ intermediate-stage switch $S_{m(K+1)}$ is coupled to the second intermediate-stage input end. When K+1 is an odd number, the other end of the $(K+1)^{th}$ intermediate-stage switch $S_{m(K+1)}$ is coupled to an in-phase input end of the $1^{st}$ intermediate-stage operational amplifier $OP_{m1}$, and when K+1 is an even number, the other end of the $(K+1)^{th}$ intermediate-stage switch $S_{m(K+1)}$ is coupled to an in-phase input end of the $2^{nd}$ intermediate-stage operational amplifier $OP_{m2}$.

One end of the $k^{th}$ intermediate-stage switch $S_{mk}$ is coupled to a common node between the $(k-1)^{th}$ intermediate-stage resistor $R_{m(k-1)}$ and the $k^{th}$ intermediate-stage resistor $R_{mk}$. When k is an odd number, the other end of the $k^{th}$ intermediate-stage switch $S_{mk}$ is coupled to an in-phase input end of the $1^{st}$ intermediate-stage operational amplifier $OP_{m1}$, and when k is an even number, the other end thereof is coupled to an in-phase input end of the $2^{nd}$ intermediate-stage operational amplifier $OP_{m2}$. k is a positive integer not less than 1 and not greater than K+1, and K is a positive integer greater than 1.

The gamma voltage generating circuit as shown in FIGS. 3 and 4 may be entirely, or partially, integrated into the source driver IC. As compared with the prior art, the number of the resistors is reduced, so it is able to facilitate the integration of the source driver IC. Alternatively, the post-stage voltage-dividing circuit as shown in FIG. 3 or 4 may be integrated into the source driver IC, so as to further reduce the number of resistors integrated into the source driver IC, and as a result, it is possible to further reduce the process complexity of the source driver IC.

In order to minimize the number of resistors, the number of the pre-stage and the number of the post-stage resistors need to be kept in balance as possible. For example, in the case of a 6-bit source driver IC, N is 8 and M is 16, and in the case of a 8-bit source driver IC, N is 16 and M is 16 too.

Alternatively, in the case of a 8-bit source driver IC, there is one intermediate-stage voltage-dividing circuit, N is 8, K is 8, and M is 4.

Second Embodiment

Figure 5:
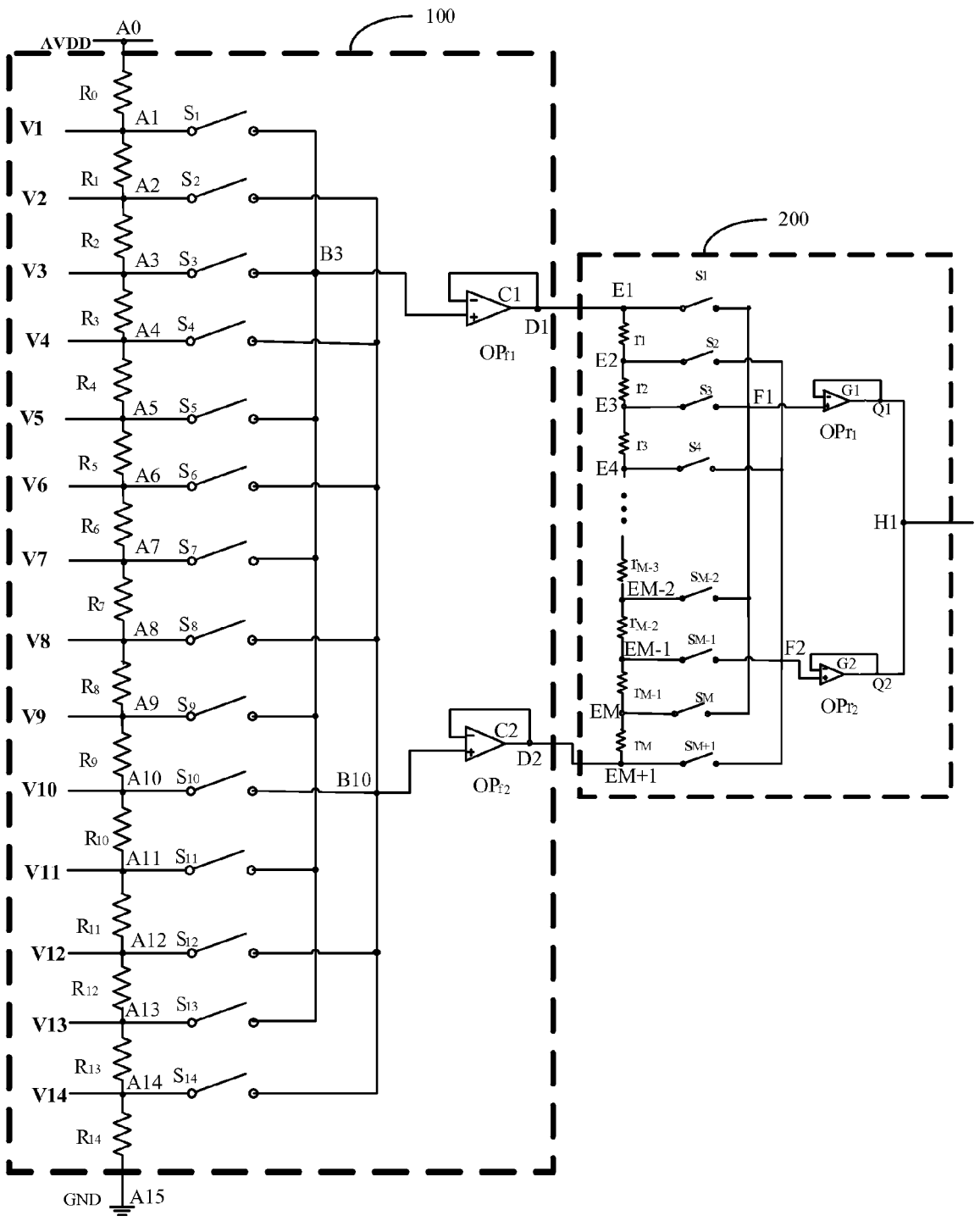
FIG. 5 is a circuit diagram of a gamma voltage generating circuit according to the second embodiment of the present invention.

FIG. 5 shows a gamma voltage generating circuit according to the second embodiment of the present invention, comprising an output end H1, a reference voltage input end A0, a pre-stage voltage-dividing circuit 100 having a first pre-stage output end D1 and a second pre-stage output end D2, and a post-stage voltage-dividing circuit 200 having a first post-stage input end E1, a second post-stage input end EM+1, and post-stage output ends (Q1, Q2).

The first pre-stage output end D1 of the pre-stage voltage-dividing circuit 100 is coupled to the first post-stage input end E1, and the second pre-stage output end D2 thereof is coupled to the second post-stage input end E2, so as to divide reference voltages AVDD from the reference voltage input ends, thereby to generate a primary gamma voltage.

The post-stage output ends (Q1, Q2) of the post-stage voltage-dividing circuit 200 are coupled to the output end H1 of the gamma voltage generating circuit, so as to divide the primary gamma voltage, thereby to generate a secondary gamma voltage.

The pre-stage voltage-dividing circuit 100 comprises N+1 pre-stage resistors (i.e., the $0^{th}$ pre-stage resistor $R_0$ to the $N^{th}$ pre-stage resistor $R_N$), N pre-stage switches (i.e., the $1^{st}$ pre-stage switch $S_1$ to the $N^{th}$ switch $S_N$), and 2 pres-stage operational amplifiers (i.e., the $1^{st}$ pre-stage operational amplifier $OP_{f1}$ and the $2^{nd}$ pre-stage operational amplifier $OP_{f2}$).

The N+1 pre-stage resistors are sequentially coupled in series. One end of the $0^{th}$ pre-stage resistor $R_0$, which is not coupled to the $1^{st}$ pre-stage resistor $R_1$ is coupled to the reference voltage input end, and one end of the $N^{th}$ resistor $R_N$, which is not coupled to the $(N-1)^{th}$ resistor $R_{N-1}$, is coupled to the ground (GND).

One end of the $n^{th}$ pre-stage switch Sn is coupled to a common node between the $(n-1)^{th}$ pre-stage resistor $R_{n-1}$ and the $n^{th}$ pre-stage resistor $R_n$. When n is an odd number, the other end of the $n^{th}$ pre-stage switch $S_n$ is coupled to an in-phase input end of the $1^{st}$ pre-stage operational amplifier $OP_{f1}$, and when n is an even number, the other end of the $n^{th}$ pre-stage switch $S_n$ is coupled to an in-phase input end of the $2^{nd}$ pre-stage operational amplifier $OP_{f2}$. n is a positive integer not less than 1 and not greater than (N+1), and N is a positive integer greater than 1.

A reverse-phase input end and an output end of the $1^{st}$ pre-stage operational amplifier $OP_{f1}$ are both coupled to the first pre-stage output end, and a reverse-phase input end and an output end of the $2^{nd}$ pre-stage operational amplifier $OP_{f2}$ are both coupled to the second pres-stage output end.

The post-stage voltage-dividing circuit 200 comprises M post-stage resistors (i.e., the $1^{st}$ post-stage resistor $r_1$ to the $M^{th}$ post-stage resistor $r_M$), M+1 post-stage switches (i.e., the $1^{st}$ post-stage switch $s_1$ to the $(M+1)^{th}$ post-stage switch $S_{M+1}$), and 2 post-stage operational amplifiers (i.e., the $1^{st}$ post-stage operational amplifier $OP_{r1}$ and the $2^{nd}$ post-stage operational amplifier $OP_{r2}$).

The M post-stage resistors are sequentially coupled in series. One end of the $1^{st}$ post-stage resistor $r_1$, which is not coupled to the $2^{nd}$ post-stage resistor $r_2$, is coupled to the first post-stage input end, and one end of the $M^{th}$ post-stage resistor $r_M$, which is not coupled to the $(M-1)^{th}$ post-stage resistor $r_{M-1}$, is coupled to the second post-stage input end.

One end of the $1^{st}$ post-stage switch $s_1$ is coupled to the first post-stage input end, and the other end thereof is coupled to an in-phase input end of the $1^{st}$ post-stage operational amplifier $OP_{r1}$. One end of the $(M+1)^{th}$ post-stage switch $S_{M+1}$ is coupled to the second post-stage input end. When M+1 is an odd number, the other end of the $(M+1)^{th}$ post-stage switch $S_{M+1}$ is coupled to an in-phase input end of the $1^{st}$ post-stage operational amplifier $OP_{r1}$, and when M+1 is an even number, the other end of the $(M+1)^{th}$ post-stage switch $S_{M+1}$ is coupled to an in-phase input end of the $2^{nd}$ post-stage operational amplifier $OP_{r2}$.

One end of the $m^{th}$ post-stage switch sm is coupled to a common node between the $(m-1)^{th}$ post-stage resistor $r_{m-1}$ and the $m^{th}$ post-stage resistor $r_m$. When m is an odd number, the other end of the $m^{th}$ post-stage switch $s_m$ is coupled to an in-phase input end of the $1^{st}$ post-stage operational amplifier $OP_{r1}$, and when m is an even number, the other end thereof is coupled to an in-phase input end of the $2^{nd}$ post-stage operational amplifier $OP_{r2}$. m is a positive integer not less than 1 and not greater than M+1, and M is a positive integer greater than 1.

A reverse-phase input end and an output end of the $1^{st}$ post-stage operational amplifier $OP_{r1}$ are both coupled to the post-stage output end, and a reverse-phase input end and an output end of the $2^{nd}$ post-stage operational amplifier $OP_{r2}$ are both coupled to the post-stage output end. The post-stage output end is coupled to the output end of the gamma voltage generating circuit.

In the gamma voltage generating circuit as shown in FIG. 5, the pre-stage voltage-dividing circuit is multiplexed by the post-stage voltage-dividing circuit. Under the function of the pre-stage voltage-dividing circuit and the post-stage voltage-dividing circuit, more gamma voltages may be generated using less resistors. As a result, it is able reduce the number of the gamma resistors, thereby to facilitate the integration of the source driver IC and reduce the process complexity of the source driver IC.

Figure 6:
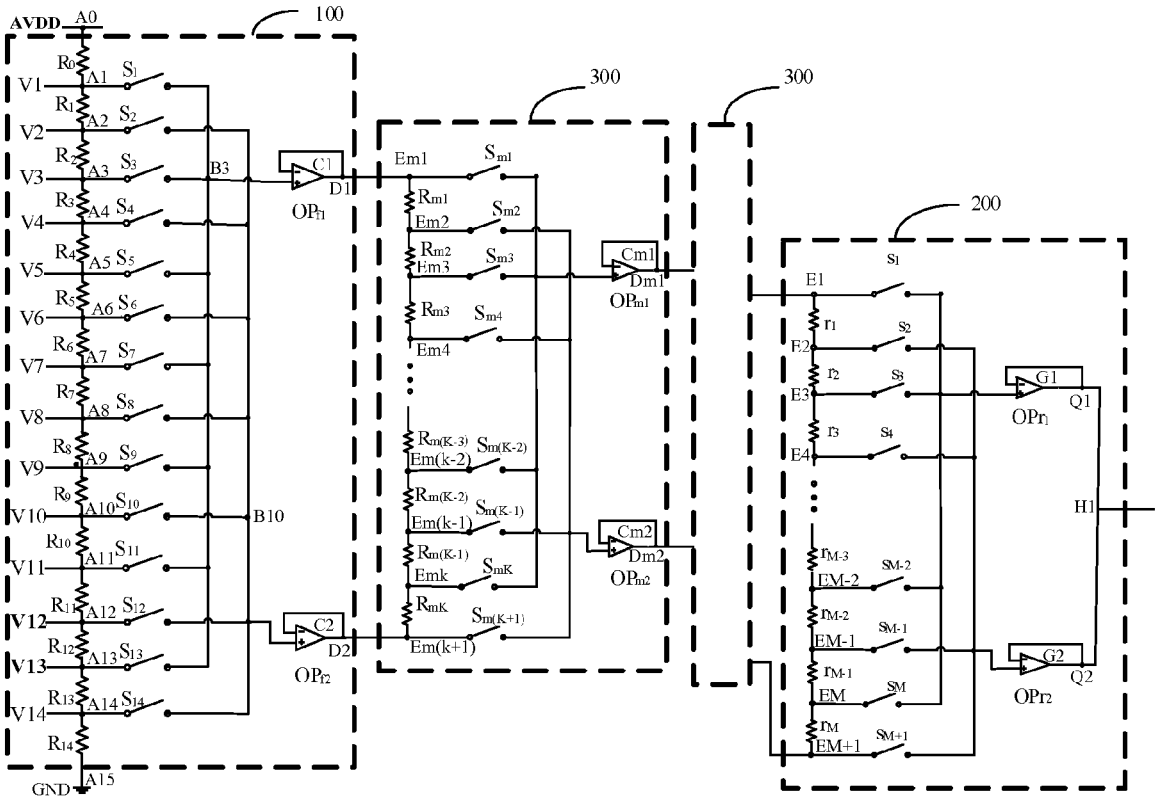
FIG. 6 is another circuit diagram of the gamma voltage generating circuit according to the second embodiment of the present invention.

The gamma voltage generating circuit in FIG. 5 may be called as a two-stage multiplex circuit. In order to generate more gamma voltages, a three-stage, or more, multiplex circuit may also be used. At this time, on the basis of the circuit as shown in FIG. 5, at least one intermediate-stage voltage-dividing circuit 300 having first intermediate-stage input/output ends and second intermediate-stage input/output ends may be be added, and its structure is shown in FIG. 6. In FIG. 6, two intermediate-stage voltage-dividing circuits are added. The circuit diagram of the second intermediate-stage voltage-dividing circuit is similar to that of the first intermediate-stage voltage-dividing circuit. FIG. 6 merely shows the connection between the second intermediate-stage voltage-dividing circuit and the first intermediate-stage voltage-dividing circuit as well as the post-stage voltage-dividing circuit, without showing the structure of the second intermediate-stage voltage-dividing circuit.

A first intermediate-stage input end of the intermediate-stage voltage-dividing circuit is coupled to a first output end of a previous-stage voltage-dividing circuit, a second intermediate-stage input end is coupled to a second output end of the previous-stage voltage-dividing circuit, a first intermediate-stage output end is coupled to a first input end of a next-stage voltage-dividing circuit, and a second intermediate-stage output end is coupled to a second input end of the next-stage voltage-dividing circuit.

On the basis of the circuit as shown in FIG. 5, when the intermediate-stage voltage-dividing circuit 300 having the first intermediate-stage input/output ends and the second intermediate-stage input/output ends is added, the previous-stage voltage-dividing circuit is just the pre-stage voltage-dividing circuit, the first input end of the previous-stage voltage-dividing circuit is just the first pre-stage output end and the second output end of the previous-stage voltage-dividing circuit is just the second pre-stage output end, while the next-stage voltage-dividing circuit is just the post-stage voltage-dividing circuit, the first input end of the next-stage voltage-dividing circuit is just the first post-stage input end and the second input end of the next-stage voltage-dividing circuit is just the second post-stage input end.

On the basis of the circuit as shown in FIG. 5, when two intermediate-stage voltage-dividing circuits (i.e., the first intermediate-stage voltage-dividing circuit and the second intermediate-stage voltage-dividing circuit) having the first intermediate-stage input/output ends and the second intermediate-stage input/output ends are added and the intermediate-stage voltage-dividing circuit is the first intermediate-stage voltage-dividing circuit, the previous-stage voltage-dividing circuit is just the pre-stage voltage-dividing circuit, the first output end of the previous-stage voltage-dividing circuit is just the first pre-stage output end and the second output end of the previous-stage voltage-dividing circuit is just the second pre-stage output end. While the next-stage voltage-dividing circuit is just second intermediate-stage voltage-dividing circuit, the first input end of the next-stage voltage-dividing circuit is the first intermediate-stage input end of the second intermediate-stage voltage-dividing circuit, the second input end of the next-stage voltage-dividing circuit is the second intermediate-stage input end of the second intermediate-stage voltage-dividing circuit. While intermediate-stage voltage-dividing circuit is the second intermediate-stage voltage-dividing circuit, the previous-stage voltage-dividing circuit is just the first intermediate-stage voltage-dividing circuit, the first output end of the previous-stage voltage-dividing circuit is just the first intermediate-stage output end of the first intermediate-stage voltage-dividing circuit and the second output end of the previous-stage voltage-dividing circuit is just the second intermediate-stage output end of the first intermediate-stage voltage-dividing circuit, while the next-stage voltage-dividing circuit is just the post-stage voltage-dividing circuit, the first input end of the next-stage voltage-dividing circuit is just the first post-stage input end and the second input end of the next-stage voltage-dividing circuit is just the second post-stage input end. When three or more intermediate-stage voltage-dividing circuits are added, the case is similar to adding two intermediate-stage voltage-dividing circuits, and it will not be repeated herein.

When merely one intermediate-stage voltage-dividing circuit 300 is included, the first intermediate-stage input end of the intermediate-stage voltage-dividing circuit 300 is coupled to the first pre-stage output end, the second intermediate-stage input end of the intermediate-stage voltage-dividing circuit 300 is coupled to the second pre-stage output end, the first intermediate-stage output end of the intermediate-stage voltage-dividing circuit 300 is coupled to the first post-stage input end, and the second intermediate-stage output end of the intermediate-stage voltage-dividing circuit 300 is coupled to the second post-stage input end.

The intermediate-stage voltage-dividing circuit 300 comprises K intermediate-stage resistors (i.e., the $1^{st}$ intermediate-stage resistor $R_{m1}$ to the $K^{th}$ intermediate-stage resistor $R_{mK}$), K+1 intermediate-stage switches (i.e., the $1^{st}$ intermediate-stage switch $S_{m1}$ to the $(K+1)^{th}$ intermediate-stage switch $S_{m(K+1)}$), and 2 intermediate-stage operational amplifiers (i.e., the $1^{st}$ intermediate-stage operational amplifier $OP_{m1}$ and the $2^{nd}$ intermediate-stage operational amplifier $OP_{m2}$).

The K intermediate-stage resistors are sequentially coupled in series. One end of the $1^{st}$ intermediate-stage resistor $R_{m1}$, which is not coupled to the $2^{nd}$ intermediate-stage resistor $R_{m2}$, is coupled to the first intermediate-stage input end, and one end of the $K^{th}$ intermediate-stage resistor $R_{mK}$, which is not coupled to the $(K-1)^{th}$ intermediate-stage resistor $R_{m(K-1)}$, is coupled to the second intermediate-stage input end.

One end of the $1^{st}$ intermediate-stage switch $S_{m1}$ is coupled to the first intermediate-stage input end, and the other end thereof is coupled to an in-phase input end of the $1^{st}$ intermediate-stage operational amplifier $OP_{m1}$. One end of the $(K+1)^{th}$ intermediate-stage switch $S_{m(K+1)}$ is coupled to the second intermediate-stage input end. When K+1 is an odd number, the other end of the $(K+1)^{th}$ intermediate-stage switch $S_{m(K+1)}$ is coupled to an in-phase input end of the $1^{st}$ intermediate-stage operational amplifier $OP_{m1}$, and when K+1 is an even number, the other end thereof is coupled to an in-phase input end of the $2^{nd}$ intermediate-stage operation amplifier $OP_{m2}$.

One end of the $k^{th}$ intermediate-stage switch $S_{mk}$ is coupled to a common node between the $(k-1)^{th}$ intermediate-stage resistor $R_{m(k-1)}$ and the $k^{th}$ intermediate-stage resistor $R_{mk}$. When k is an odd number, the other end of the $k^{th}$ intermediate-stage switch $S_{mk}$ is coupled to an in-phase input end of the $1^{st}$ intermediate-stage operational amplifier $OP_{m1}$, and when k is an even number, the other end of the $k^{th}$ intermediate-stage switch $S_{mk}$ is coupled to an in-phase input end of the $2^{nd}$ intermediate-stage operational amplifier $OP_{m2}$. k is a positive integer not less than 1 and not greater than K+1, and K is a positive integer greater than 1.

A reverse-phase input end and an output end of the $1^{st}$ intermediate-stage operational amplifier $OP_{m1}$ are both coupled to the first intermediate-stage output end, and a reverse-phase input end and an output end of the $2^{nd}$ intermediate-stage operational amplifier $OP_{m2}$ are both coupled to the second intermediate-stage output end.

The gamma voltage generating circuit as shown in FIGS. 5 and 6 may be entirely, or partially, integrated into the source driver IC. As compared with the prior art, the number of the resistors is reduced, so it is able to facilitate the integration of the source driver IC. Preferably, the post-stage voltage-dividing circuit as shown in FIG. 5 or 6 may be integrated into the source driver IC, so as to further reduce the number of resistors integrated into the source driver IC, and as a result, it is possible to further reduce the process complexity of the source driver IC.

In the case of a 6-bit source driver IC, N is 8 and M is 16, and in the case of a 8-bit source driver IC, N is 16 and M is 16 too.

In the case of a 8-bit source driver IC, there is one intermediate-stage voltage-dividing circuit, N is 8, K is 8, and M is 4.

Third Embodiment

In this embodiment, a method is provided for controlling the gamma voltage generating circuit according to the first or second embodiment. The gamma voltage generating circuit has the structure shown in FIGS. 3 to 6 and mentioned in the above first and second embodiments, which will not be repeated herein. The method for controlling the gamma voltage generating circuit comprises: determining a desired gamma voltage by a source driver; dividing reference voltages input from a first reference voltage input end and a second reference voltage input end, respectively, so as to generate a primary gamma voltage by a pre-stage voltage-dividing circuit; dividing the primary gamma voltage by a post-stage voltage-dividing circuit, so as to generate a secondary gamma voltage; and outputting the desired gamma voltage through an output end of the gamma voltage generating circuit.

Further, the secondary gamma voltage is just the gamma voltage desired for the source driver, the pre-stage voltage-dividing circuit comprises a first switch group, and the post-stage voltage-dividing circuit comprises a second switch group.

The source driver determines the desired gamma voltage, determines the switch group corresponding to the desired gamma voltage in accordance with the correspondence between the switch group and the gamma voltage, and switches off the corresponding switch group.

Figure 1:
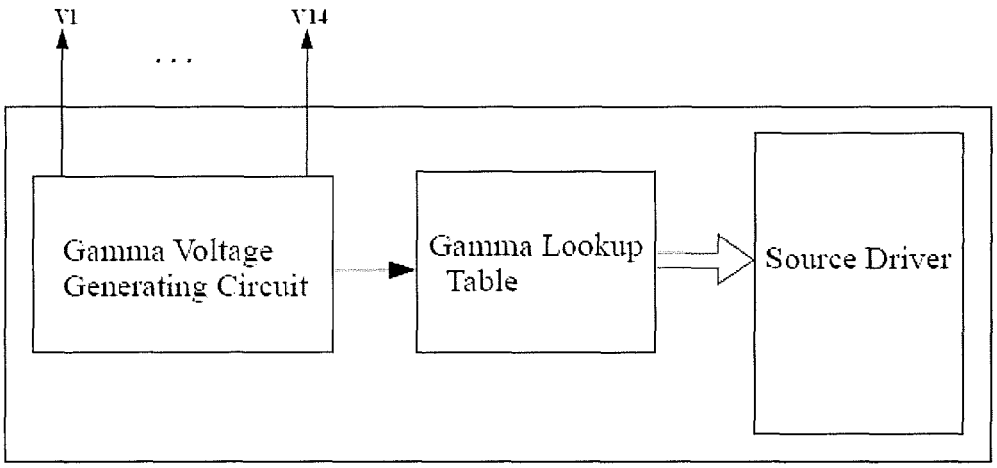
PRIOR ART Fig.1
FIG. 1 is a block diagram showing an existing source driver IC.
Figure 2:
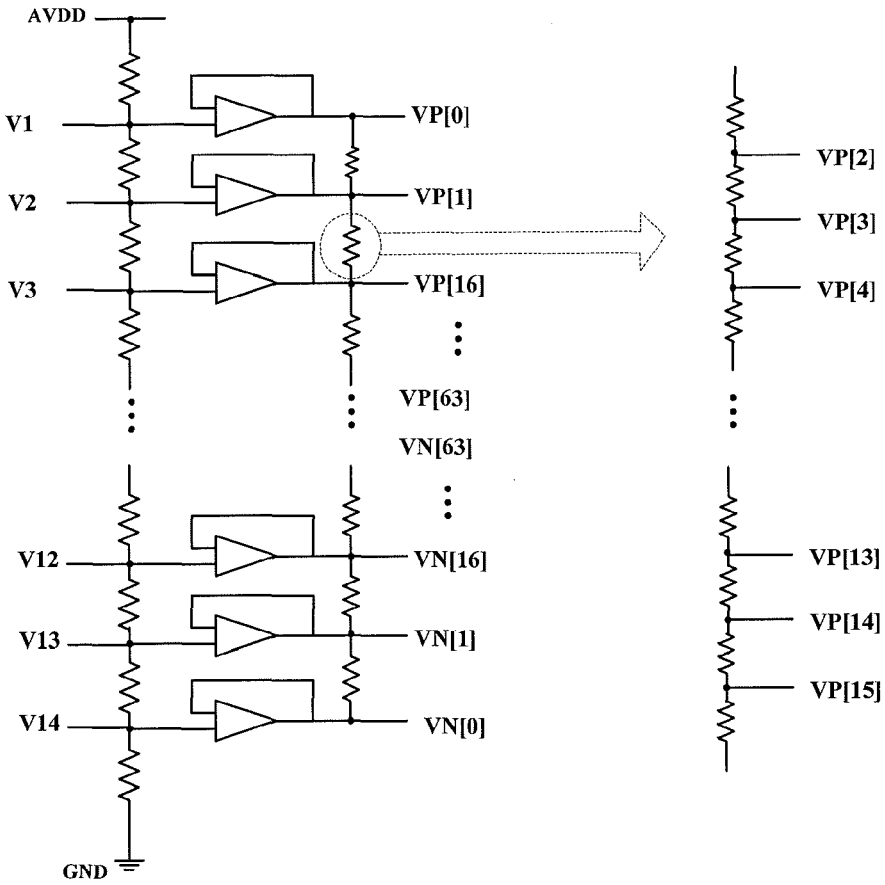
PRIOR ART Fig.2
FIG. 2 is a view showing a gamma voltage generating circuit in the existing source driver IC.

The correspondence between the switch group and the gamma voltage may be stored in a gamma lookup table in FIG. 1 which is a block diagram of the source driver IC.

It should be appreciated that, the switch group may comprises a first switch group, a second switch group, a first intermediate switch group, and additional switches to be added when it is required to add a certain stage of the voltage-dividing circuit. The correspondence between the switch group and the gamma voltage refers to the correspondence between a single, or a plurality of, switches in each stage of the voltage-dividing circuit in the gamma voltage generating circuit (e.g., the pre-stage voltage-dividing circuit) and the gamma voltage.

During the actual implementation, the switch group may be determined in accordance with the actually required gamma voltage and the gamma voltage generating circuit, so as to output the actually required gamma voltage when the determined switch group is in a switch-off state (while the other switch groups is in a switch-on state).

While V[n] represents the voltage at each stage, the correspondence between the switch group and the gamma voltage is listed hereinafter by taking the gamma voltage generating circuit in FIG. 3 as an example.

V[1]: (=V1) S1 and s1 OFF;
V[2]: (=V2) S2 and s17 ON;
V[3]: S2, S3 and s16 OFF;
V[4]: S2, S3 and s15 OFF;
V[5]: S2, S3 and s14 OFF;
V[6]: S2, S3 and s13 OFF;
V[7]: S2, S3 and s12 OFF;
V[8]: S2, S3 and s11 OFF;
V[9]: S2, S3 and s10 OFF;
V[10]: S2, S3 and s9 OFF;
V[11]: S2, S3 and s8 OFF;
V[12]: S2, S3 and s7 OFF;
V[13]: S2, S3 and s6 OFF;
V[14]: S2, S3 and s5 OFF;
V[15]: S2, S3 and s4 OFF;
V[16]: S2, S3 and s3 OFF;
V[17]: S2, S3 and s2 OFF;
V[18]: (=V3) S3 and s1 OFF;
V[19]: S3, S4 and s2 OFF;
V[20]: S3, S4 and s3 OFF;
V[21]: S3, S4 and s4 OFF;
V[22]: S3, S4 and s5 OFF;
V[23]: S3, S4 and s6 OFF;
V[24]: S3, S4 and s7 OFF;
V[25]: S3, S4 and s8 OFF;
V[26]: S3, S4 and s9 OFF;
V[27]: S3, S4 and s10 OFF;
V[28]: S3, S4 and s11 OFF;
V[29]: S3, S4 and s12 OFF;
V[30]: S3, S4 and s13 OFF;
V[31]: S3, S4 and s14 OFF;
V[32]: S3, S4 and s15 OFF;
V[33]: S3, S4 and s16 OFF;
V[34]: (=V4) S4 and s17 OFF;
V[35]: S4, S5 and s16 OFF;
V[36]: S4, S5 and s15 OFF;
V[37]: S4, S5 and s14 OFF;
V[38]: S4, S5 and s13 OFF;
V[39]: S4, S5 and s12 OFF;
V[40]: S4, S5 and s11 OFF;
V[41]: S4, S5 and s10 OFF;
V[42]: S4, S5 and s9 OFF;
V[43]: S4, S5 and s8 OFF;
V[44]: S4, S5 and s7 OFF;
V[45]: S4, S5 and s6 OFF;
V[46]: S4, S5 and s5 OFF;
V[47]: S4, S5 and s4 OFF;
V[48]: S4, S5 and s3 OFF;
V[49]: S4, S5 and s2 OFF;
V[50]: (=V5) S5 and s1 OFF . . . .

Fourth Embodiment

An embodiment of the present invention further provides a liquid crystal display comprising the gamma voltage generating circuit mentioned in the first, second or third embodiments. Apart from the gamma voltage generating circuit, the other parts of the liquid crystal display have the structures similar to an existing liquid crystal display, which will not be repeated herein.

It should be appreciated that, embodiments of the present invention may be provided as a method, a system or a computer program product, so the present invention may be implemented in the form of full hardware embodiments, full software embodiments, or combinations thereof. In addition, the present invention may be in the form of a computer program product implemented on one or more computer-readable storage mediums (including but not limited to disk memory, CD-ROM and optical memory) including computer-readable program codes.

The present invention is described with reference to the flow charts and/or block diagrams showing the method, device (system) and computer program product according to the embodiments of the present invention. It should be appreciated that each process and/or block, or combinations thereof, in the flow charts and/or block diagrams may be implemented via computer program. These computer program may be applied to a general-purpose computer, a special-purpose computer, an embedded processor or any other processor of programmable data processing equipment, so as to form a machine, thereby to obtain the device capable of implementing the functions specified in one or more processes in the flow charts and/or one or more blocks in the block diagrams in accordance with the computer program executed by the computer or the processor of the other programmable data processing equipment.

These computer program may also be stored in a computer-readable memory capable of guiding the computer or the other programmable data processing equipment to work in a special manner, so as to form a product including a command device capable of implementing the functions specified in one or more processes in the flow charts and/or one or more blocks in the block diagrams.

These computer program may also be loaded onto a computer or the other programmable data processing equipment, so as to perform a series of operations thereon and generate the processing implemented by the computer, thereby to provide the steps capable of implementing the functions specified one or more processes in the flow charts and/or one or more blocks in the block diagrams in accordance with the instructions.

Although the preferred embodiments are described above, a person skilled in the art may make modifications and alterations to these embodiments in accordance with the basic concept of the present invention. So, the attached claims are intended to include the preferred embodiments and all of the modifications and alterations that fall within the scope of the present invention.

What is claimed is:

1. A gamma voltage generating circuit, comprising: an output end, a first reference voltage input end, a second reference voltage input end, a pre-stage voltage-dividing circuit having a first pre-stage output end and a second pre-stage output end, and a post-stage voltage-dividing circuit having a first post-stage input end, a second post-stage input end and a post-stage output end, wherein the first reference voltage input end and the second reference voltage input end are coupled to the pre-stage voltage-dividing circuit respectively, the pre-stage voltage-dividing circuit is coupled to the post-stage voltage-dividing circuit, and the post-stage voltage-dividing circuit is coupled to the output end of the gamma voltage generating circuit;

the first pre-stage output end of the pre-stage voltage-dividing circuit is coupled to the first post-stage input end, and the second pre-stage output end of the pre-stage voltage-dividing circuit is coupled to the second post-stage input end, so as to divide reference voltages input from the first reference voltage input end and the second reference voltage input end, respectively, thereby to generate a primary gamma voltage; and the post-stage output end of the post-stage voltage-dividing circuit is coupled to the output end of the gamma voltage generating circuit, so as to divide the primary gamma voltage, thereby to generate a secondary gamma voltage, wherein the pre-stage voltage-dividing circuit comprises N+1 pre-stage resistors composed of the $O^{th}$ pre-stage resistor to the $N^{th}$ pre-stage resistor, N pre-stage switches composed of the $1^{th}$ pre-stage switch to the $N^{th}$ pre-stage switch, and only two pre-stage operational amplifiers composed of the $1^{th}$ pre-stage operational amplifier and the $2^{nd}$ pre-stage operational amplifier; the N+1 pre-stage resistors composed of the $0^{th}$ pre-stage resistor to the $N^{th}$ pre-stage resistor are sequentially coupled in series, one end of the $0^{th}$ pre-stage resistor is coupled to the $1^{st}$ re-stage resistor the other end of the $0^{th}$ pre-stage resistor is coupled to the first reference voltage input end, one end of the $N^{th}$ pre-stage resistor is coupled to the $(N-1)^{th}$ pre-stage resistor, and the other end of the $N^{th}$ pre-stage resistor is coupled to the second reference voltage input end, wherein N is a positive integer greater than 8.

2. The gamma voltage generating circuit according to claim 1, wherein one end of the $n^{th}$ pre-stage switch is coupled to a common node between the $(n-1)^{th}$ pre-stage resistor and the $n^{th}$ pre-stage resistor, and the other end of the $n^{th}$ pre-stage switch is coupled to an in-phase input end of the $1^{st}$ or the $2^{nd}$ pre-stage operational amplifier, wherein n is a positive integer not less than 1 and not greater than (N+1).

3. The gamma voltage generating circuit according to claim 1, wherein the post-stage voltage-dividing circuit is integrated into a source driver IC.

4. A liquid crystal display comprising the gamma voltage generating circuit according to claim 1.

5. The gamma voltage generating circuit according to claim 2, wherein when n is an odd number, the other end of the $n^{th}$ pre-stage switch is coupled to an in-phase input end of the $1^{st}$ pre-stage operational amplifier, and when n is an even number, the other end of the $n^{th}$ pre-stage switch is coupled to an in-phase input end of the $2^{nd}$ pre-stage operational amplifier; and a reverse-phase input end and an output end of the $1^{st}$ pre-stage operational amplifier are both coupled to the first pre-stage output end, and a reverse-phase input end and an output end of the $2^{nd}$ pre-stage operational amplifier are both coupled to the second pre-stage output end.

6. The gamma voltage generating circuit according to claim 5, wherein the post-stage voltage-dividing circuit comprises: M post-stage resistors composed of the $1^{st}$ post-stage resistor to the $M^{th}$ post-stage resistor, M+1 post-stage switches composed of the $1^{st}$ post-stage switch to the $(M+1)^{th}$ post-stage switch, and R post-stage operational amplifiers composed of the $1^{st}$ post-stage operational amplifier to the $R^{th}$ post-stage operational amplifier, wherein R is a positive integer not less than 1;

the M post-stage resistors composed of the $1^{st}$ post-stage resistor to the $M^{th}$ post-stage resistor, are sequentially coupled in series, one end of the $1^{st}$ post-stage resistor is coupled to the $2^{nd}$ post-stage resistor, the other end of the $1^{st}$ post-stage resistor is coupled to the first post-stage input end, one end of the $M^{th}$ post-stage resistor is coupled to the $(M-1)^{th}$ post-stage resistor, and the other end of the $M^{th}$ post-stage resistor is coupled to the second post-stage input end;

one end of the $1^{st}$ post-stage switch is coupled to the first post-stage input end, the other end of the $1^{st}$ post-stage switch is coupled to an in-phase input end of any one of the R post-stage operational amplifies, one end of the $(M+1)^{th}$ post-stage switch is coupled to the second post-stage input end, and the other end of the $(M+1)^{th}$ post-stage switch is coupled to an in-phase input end of any one of the R post-stage operational amplifiers, one end of the $m^{th}$ post-stage switch is coupled to a common node between the $(m-1)^{th}$ post-stage resistor and the $m^{th}$ post-stage resistor, and the other end of the $m^{th}$ post-stage switch is coupled to an in-phase input end of any one of the R post-stage operational amplifiers, wherein m is a positive integer not less than 1 and not greater than M+1, and M is a positive integer greater than 1; and among the R post-stage operational amplifiers, the reverse-phase input end and the output end of each post-stage operational amplifier are both coupled to the post-stage output end.

7. The gamma voltage generating circuit according to claim 6, wherein R is 2, the other end of the $1^{st}$ post-stage switch is coupled to an in-phase input end of the $1^{st}$ post-stage operation amplifier, wherein when M+1 is an odd number, the other end of the $(M+1)^{th}$ post-stage switch is coupled to an in-phase input end of the $1^{st}$ post-stage operational amplifier, and when M+1 is an even number, the other end of the $(M+1)^{th}$ post-stage switch is coupled to an in-phase input end of the $2^{nd}$ post-stage operational amplifier; and when m is an odd number, the other end of the $m^{th}$ post-stage switch is coupled to an in-phase input end of the $1^{st}$ post-stage operational amplifier, and when m is an even number, the other end of the $m^{th}$ post-stage switch is coupled to an in-phase input end of the $2^{nd}$ post-stage operational amplifier.

8. The gamma voltage generating circuit according to claim 6, wherein the circuit further comprises at least one intermediate-stage voltage-dividing circuit having first intermediate-stage input/output ends and second intermediate-stage input/output ends;

the first intermediate-stage input end of the intermediate-stage voltage-dividing circuit is coupled to a first output end of a previous-stage voltage-dividing circuit, the second intermediate-stage input end is coupled to a second output end of the previous—stage voltage-dividing circuit, the first intermediate-stage output end is coupled to a first input end of a next-stage voltage-dividing circuit, and the second intermediate-stage output end is coupled to a second input end of the next-stage voltage-dividing circuit, so as to divide a voltage output from the previous-stage voltage-dividing circuit; and the post-stage voltage-dividing circuit is configured to divide the voltage output from the previous-stage voltage-dividing circuit so as to as generate the secondary gamma voltage.

9. The gamma voltage generating circuit according to claim 6, wherein for a 6-bit source driver IC, N is 8 and M is 16, and for an 8-bit source driver IC, N is 16 and M is 16.

10. The gamma voltage generating circuit according to claim 8, wherein the intermediate-stage voltage-dividing circuit comprises K intermediate-stage resistors composed of the $1^{st}$ intermediate-stage resistor to the $K^{th}$ intermediate-stage resistor, K+1 intermediate-stage switches composed of the $1^{st}$ intermediate-stage switch to the $(K+1)^{th}$ intermediate-stage switch, and 2 intermediate-stage operational amplifiers composed of the $1^{st}$ intermediate-stage operational amplifier and the $2^{nd}$ intermediate-stage operational amplifier;

the K intermediate-stage resistors composed of the $1^{st}$ intermediate-stage resistor to the $K^{th}$ intermediate-stage resistor are sequentially coupled in series, one end of the $1^{st}$ intermediate-stage resistor is coupled to the $2^{nd}$ intermediate-stage resistor, the other end of the $1^{st}$ intermediate-stage resistor is coupled to the first intermediate-stage input end, one end of the $K^{th}$ intermediate-stage resistor is coupled to the $(K-1)^{th}$ intermediate-stage resistor, and the other end of the $K^{th}$ intermediate-stage resistor is coupled to the second intermediate-stage input end;

one end of the $1^{st}$ intermediate-stage switch is coupled to the first intermediate-stage input end, the other end of the $1^{st}$ intermediate-stage switch is coupled to an in-phase input of the $1^{st}$ or $2^{nd}$ intermediate-stage opeational amplifer, one end of the $(K+1)^{th}$ intermediate-stage switch is coupled to the second intermediate-stage input end, the other end of the $(K+1)^{th}$ intermediate-stage switch is coupled to an in-phase input end of the $1^{st}$ or $2^{nd}$ intermediate-stage operational amplifier, one end of the $k^{th}$ intermediate-stage switch is coupled to a common node between the $(k-1)^{th}$ intermediate-stage resistor and the $k^{th}$ intermediate-stage resistor, the other end of the $k^{th}$ intermediate-stage switch is coupled to an in-phase input end of the $1^{st}$ or $2^{nd}$ intermediate-stage operational amplifier, wherein k is a positive integer greater than 1 and not greater than K+1, and K is a positive integer greater than 1; and a reverse out-phase input end and an output end of the $1^{st}$ intermediate-stage operational amplifier are both coupled to the first intermediate-stage output end, and a reverse-phase input end and an output end of the $2^{nd}$ intermediate-stage operational amplifier are both coupled to the second intermediate-stage output end.

11. The gamma voltage generating circuit according to claim 10, wherein the other end of the $1^{st}$ intermediate-stage switch is coupled to an in-phase input end of the $1^{st}$ intermediate-stage operational amplifier, and when K+1 is an odd number, the other end of the $1^{st}$ intermediate-stage switch is coupled to an in-phase input end of the $1^{st}$ intermediate-stage operational amplifier, when K+1 is an even number, the other end of the $1^{st}$ intermediate-stage switch is coupled to an in-phase input end of the $2^{nd}$ intermediate-stage operational amplifier, when k is an odd number, the other end of the $k^{th}$ intermediate-stage switch is coupled to an in-phase input end of the $1^{st}$ intermediate-stage operational amplifier, and when k is an even number, the other end of the $k^{th}$ intermediate-stage switch is coupled to an in-phase input end of the $2^{nd}$ intermediate-stage operational amplifier.

12. The gamma voltage generating circuit according to claim 10, wherein for an 8-bit source driver IC, the gamma voltage generating circuit comprises an intermediate-stage voltage-dividing circuit, and wherein N is 8, M is 4, and K is 8.

13. The gamma voltage generating circuit according to claim 11, wherein for an 8-bit source driver IC, the gamma voltage generating circuit comprises an intermediate-stage voltage-dividing circuit, and wherein N is 8, M is 4, and K is 8.

* * * * *